Fig. 1
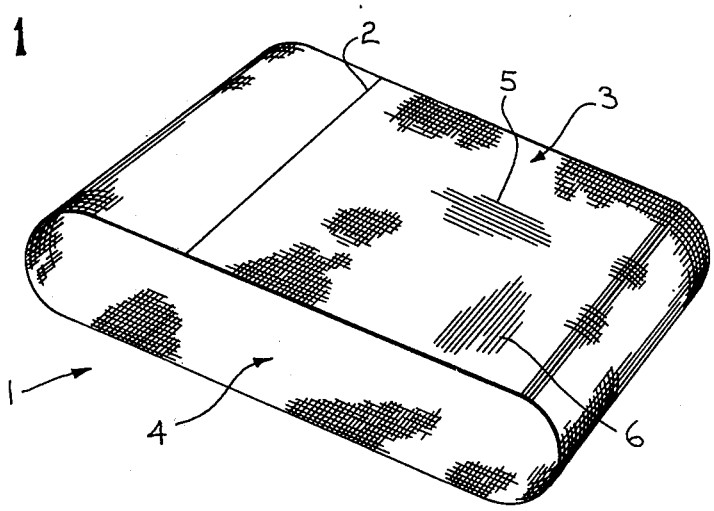
Fig. 8
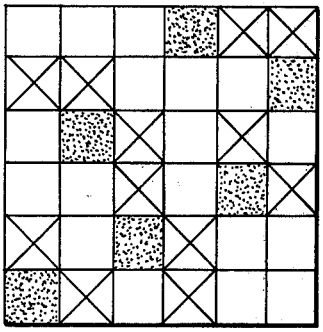
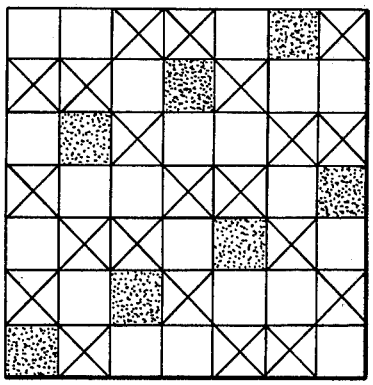
Fig. 9
Fig. 10
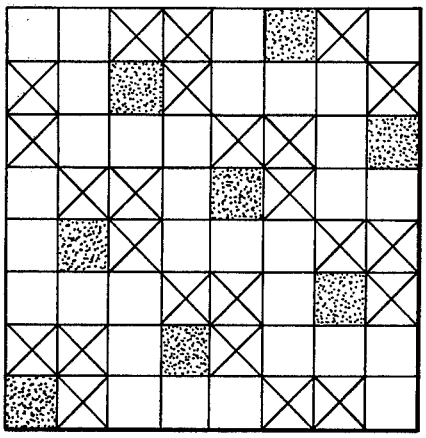

United States Patent [19]

Khan

[11] 4,161,195

[45] Jul. 17, 1979

[54] NON-TWILL PAPERFORMING FABRIC

[75] Inventor: Mir I. A. Khan, Appleton, Wis.

[73] Assignee: Albany International Corp., Albany, N.Y.

[21] Appl. No.: 878,317

[22] Filed: Feb. 16, 1978

[51] Int. Cl.[2] ..... D03D 15/00; D21F 1/10

[52] U.S. Cl. ..... 139/383 A; 139/425 A; 162/348; 162/DIG. 1

[58] Field of Search ..... 139/383 R, 383 A, 420 R, 139/425 R, 425 A; 162/348, DIG. 1

[56] References Cited

U.S. PATENT DOCUMENTS

| | | | |
|---|---|---|---|
| 1,733,116 | 10/1929 | Coups | 139/425 A |
| 3,211,606 | 10/1965 | Watson | 162/348 |
| 3,705,079 | 12/1972 | Lee et al. | 162/348 |
| 3,858,623 | 1/1975 | Lefkowitz | 139/425 A |

FOREIGN PATENT DOCUMENTS

| | | | |
|---|---|---|---|
| 582321 | 11/1946 | United Kingdom | 139/425 A |

OTHER PUBLICATIONS

The American Cotton Handbook, vol. 2, pp. 589–591.
Deutsche Textiltechnik 8 (1958) Heft 12, H. J. Thomas, pp. 593–595.
Appleton Wire Brochure for Design M–5.

*Primary Examiner*—Henry Jaudon
*Attorney, Agent, or Firm*—Quarles & Brady

[57] ABSTRACT

A paperforming fabric of synthetic, monofilament threads is shown as woven in five, or a greater number of harnesses, the warp and weft threads of which it is comprised being interwoven in a non-regular twill pattern with the threads of each thread system interlaced through the fabric to have sufficient crossovers on each fabric face to produce an even sided fabric.

16 Claims, 10 Drawing Figures

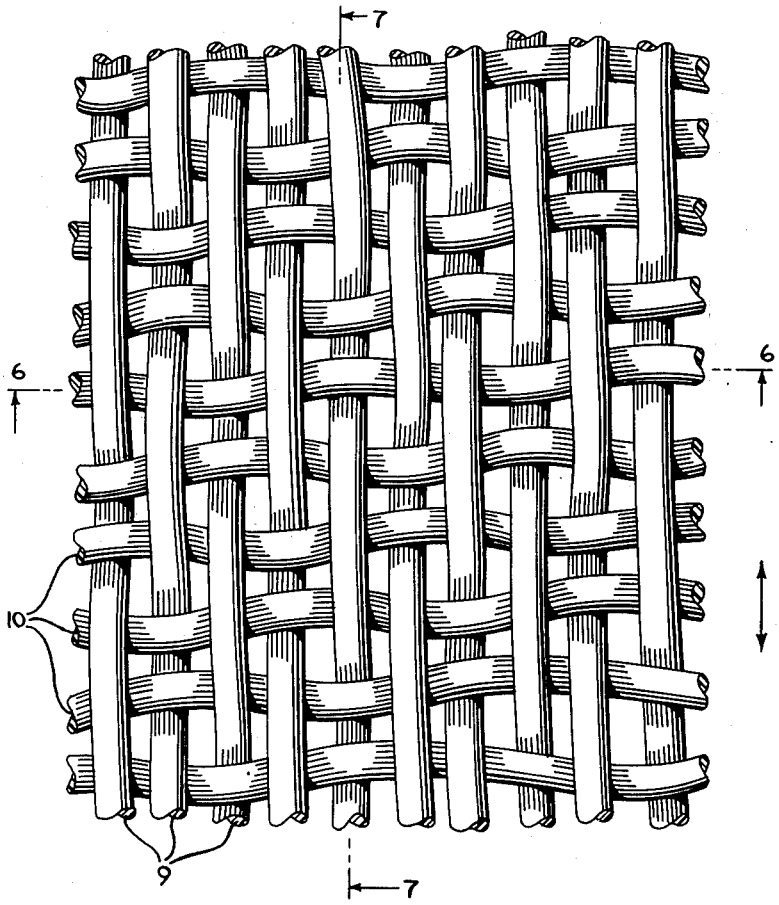

NON-TWILL PAPERFORMING FABRIC

BACKGROUND OF THE INVENTION

1. Field of the Invention

The present invention relates to paperforming fabrics as used in the wet end of papermaking machines. In the wet end paper pulp, or stock, is evenly distributed over a foraminous belt-like fabric, and water in the stock drains through the fabric to set up, or form, the initial paper web. Fourdrinier and Vertiformer machines are two typical types of wet end machines, and paperforming fabrics for Fourdriniers may be as wide as 400 inches and as long as two hundred feet. These belt-like fabrics travel over rolls, foils, suction boxes and other machine elements up to speeds of 4,000 feet per minute, and when propelled at such velocities the stresses developed in the fabric threads become very substantial.

Forming fabrics are woven on a loom from fine threads numbering from about forty to one hundred twenty threads per inch. The open area of a single layer fabric is typically 18 to 24 percent of the total fabric area, and the thread structure and minute openings between threads must be uniform across the entire fabric to obtain proper drainage and paper formation. They are, therefore, a precisely manufactured product that must exhibit several characteristics to achieve satisfactory operation.

Paperforming fabrics, for example, must not stretch excessively under the applied tension loads required to drive them along and through a paperforming machine, for otherwise they may lose tight engagement with the driving rolls and slip. They must not contract excessively in width, nor can they wrinkle across their surfaces as tensions change along their route in the papermaking machine. The knuckle formation of the threads must be uniform and there cannot be any blemishes in the fabric surface that might mark paper being produced. The water drainage rate through a fabric must also be carefully controlled, and each papermaking machine has its own, individual characteristics that must be satisfied, so that fabrics are usually designed for a specific machine.

The paper supporting surface of a fabric must allow the paper sheet to lift freely off the fabric as it passes to the next stage of the papermaking process. Also, the fabric must be able to withstand abrasive wear resulting from friction with the machine elements, so as to have a satisfactory life. As wear occurs, the threads in the machine direction, i.e. the direction of travel, must retain sufficient cross section area to withstand the tension loading to which they are subjected in pulling the fabric through the machine. Consequently, it is commonly necessary to relieve the machine direction threads from supporting the fabric on the machine.

To meet the foregoing requirements, a thread material must be selected that does not have excessive elasticity or plasticity, and the machine direction and cross direction threads must have interlocking crimp that bind them in place, so that they do not shift relative to each other, and so that they do not straighten out or undergo a crimp interchange in response to tension loads. A stable fabric can then be provided that does not excessively stretch or narrow, and in which the individual threads retain their relative positions.

The knuckle heights of the machine direction and cross direction thread systems also must be carefully controlled. For example, on the wear, or bearing side of the fabric predominant knuckles are commonly created in the cross direction threads to absorb a greater proportion of the wear, thereby protecting the tension loaded machine direction threads. On the paperforming side, the knuckle crests of the two thread systems are commonly brought into a common plane to provide a smooth paper supporting surface relatively free from excessive marking of the paper sheet. In some applications knuckle configurations are varied to achieve other specific goals. For example, long cross machine direction knuckles on the paper side may be raised to improve crosswise alignment of the paper fibers, or other knuckle arrangements may be employed to effect better sheet release.

It is seen that the field of manufacture of paperforming fabrics concerns a precise product having stringent requirements for satisfactory production of paper.

2. Description of the Prior Art

Traditional paperforming fabrics were flat woven on specially constructed looms from metal threads. Bronzes were typically used for the warp threads, which became the machine direction threads on the papermaking machine, and brass was used for the weft threads, which were the cross machine direction threads on the papermaking machine. Other metallic materials were used for special fabric constructions. In earlier times, these metal fabrics were traditionally woven in a plain weave, with the threads of each of the warp and weft thread systems interlacing through the fabric in a one over-one under pattern. A plain weave utilizes two harnesses in the loom for changing the warp shed, and can therefore be termed a two harness weave.

In time, the semi-twill weave became more popular, using three harnesses in the loom for changing the warp shed. In the semi-twill, the threads of each thread system interlace through the fabric so as to pass to one side of a thread of the opposite thread system and then to the other side of a pair of threads of the opposite thread system. Occasionally, metal fabrics also embodied a four-harness weave in a two over-two under twill pattern. However, because of the inherent dimensional stability exhibited by metal threads there was little experimentation or use beyond the semi-twill weave.

In the late 1950's and ensuing 1960's synthetic thread materials came into use, and have now largely supplanted metal. Polyester and polyamide materials in monofilament and multifilament threads have been preferred, with polyester monofilament threads being the most widely accepted forming fabric material today. Synthetics have quite different elastic and plastic properties than metal, and manufacturing a synthetic fabric requires an additional step of heat setting under tension after weaving to dimensionally stabilize the fabric. By controlling the processes of weaving and heat setting, and by selecting thread diameters and mesh counts, persons skilled in the art have come to exercise significant control over fabric characteristics such as the fabric modulus, thread crimp, and knuckle formation.

With the advent of synthetic materials, new weave patterns have come into predominant use. Four-harness weaves are commonly employed, in which individual threads in both thread systems pass first to one side of a thread of the other thread system, and then interlace through the fabric to pass to the opposite side of three threads of the other thread system. Thus each thread forms knuckles on one face of the fabric comprised of a single crossover, and long knuckles on the opposite fabric face of three crossovers. Some of the four-harness weaves are in a regular twill pattern, in which the knuckles comprising single thread crossovers are in a one-two-three-four sequence. Wider use has been made of the broken satin pattern, in which the knuckles comprising a single thread crossover are in a one-three-two-four sequence. Also, some two over-two under four-harness fabrics have been utilized in both regular twill and broken satin.

Synthetic fabrics have also been constructed in five-harness weaves in a satin pattern. Five-harness satin patterns have their knuckles of a single thread crossover woven in a one-three-five-two-four sequence, or a one-four-two-five-three sequence. Weaves employing greater than five harnesses have also been suggested, and the term "Atlas" has been used to generally denote fabrics of five or a greater number of harnesses in which each thread of each thread system passes to one side of a single thread of the other thread system and then interlaces through the fabric to pass in a long knuckle, or float to the other side of the remaining threads of the other thread system in the weave repeat. Some usage has also been made of five-harness fabrics constructed in two over-three under patterns which produce a regular twill pattern.

As used herein, the term "regular twill" means a fabric pattern having a succession of adjacent threads that present on a fabric face equal length knuckles comprised of two or more crossover in which each successive thread advances its weave repeat by one crossover from the preceding thread, to form the characteristic diagonal line that distinguishes a twill. In many instances a regular twill pattern has the disadvantage of producing a corresponding mark on the paper surface which can be objectionable. Other patterns resembling a regular twill may also at times produce similar paper marking. For example, a four-harness satin weave may produce a paper mark somewhat characteristic of a regular twill weave marking. As discussed hereinafter, it is an objective of the present invention to reduce such marking, while at the same time preserving other desirable characteristics for a paperforming fabric.

SUMMARY OF THE INVENTION

The present invention resides in a paperforming fabric of interwoven machine and cross machine direction threads that are in a weave of at least five harnesses with sufficient interlacings in both thread systems to develop a granite pattern, as hereinafter defined, that does not have a regular twill pattern.

Fabrics of the invention have a substantial number of interlacings in their weave repeats to develop relatively short thread knuckles, as contrasted with the commonly used Atlas weaves in which the weave repeat of a thread has a short knuckle on one fabric side constituting a single crossover followed by a long knuckle, or float on the opposite fabric side constituting crossovers of the remaining threads in the weave repeat. The increase in interlacings gives the fabric a greater amount of crimp to hold the threads in place, and dimensional stability should be enhanced. The interlacings also produce a knuckle pattern that reduces marking of the paper web, and particularly marking due to regular twill and long knuckle constructions.

The fabric may be woven from synthetic, monofilament threads in a five-harness weave, which results in a weave repeat of five crossovers. The weave repeat for threads of the first thread system may begin with a thread crossing a single thread of the second thread system on one side of the fabric, then lacing through the fabric to cross a single thread of the second thread system on the other side of the fabric, then lacing back through the fabric to cross another single thread of the second thread system on the first fabric side, and then lacing back through the fabric to cross a pair of threads of the second thread system on the other side of the fabric. This weave repeat can be called a one-one-one-two pattern. The weave repeat for threads of the second thread system will begin with a thread crossing a set of three threads of the first thread system on one side of the fabric, then lacing through the fabric to cross a pair of threads of the first thread system on the opposite side of the fabric. This weave repeat can be termed a two-three pattern. The knuckles of successive threads of each thread system are advanced in a manner that avoids a regular twill pattern. The average knuckle length for the resulting fabric is shorter than for other five-harness weaves, and an even sided structure is also obtained.

The two thread systems just described can be oriented in several arrangements. The first thread system, having a weave repeat of one-one-one-two, can be the machine direction threads with the longer knuckles of two crossovers on the paper side of the fabric. The second thread system, of a two-three pattern, will then have its longer knuckles of three crossovers on the wear side of the fabric, and they will be in the cross machine direction. A second orientation can be a turning of the weave pattern top to bottom, so that the knuckles that appeared on the paper side are now on the fabric wear side. A still further orientation is to have the threads of the one-one-one-two repeat in the cross machine direction, and the other threads then fall in the machine direction.

The fabric can be woven and subsequently heat treated under conditions that can produce a variety of desired knuckle height. The cross machine direction thread knuckles on the wear side can be exposed beneath the machine direction threads to absorb most of the abrasive wear. On the paper supporting side, the crests of the knuckles of the two thread systems can be brought into a common plane to provide a smooth surface for fiber support. Or, the machine direction thread knuckles on the paper side may be raised, or alternatively lowered, with respect to the cross machine thread knuckles to obtain the surface texture most desirable for a particular paper grade or papermaking machine.

Other embodiments of the invention may be woven in weaves of greater harness counts, such as in six, seven or eight harness weaves. Although specific patterns may differ substantially, the desired characteristics of even-sidedness, relatively short machine direction knuckles, and the absence of continuous regular twill lines remain. To achieve patterns of the invention, they may be woven in what is termed herein as a "granite" pattern. A granite pattern is a satin, or broken satin of at least five harnesses modified by the addition of crossovers adjacent to the single crossover knuckles of the satin in a manner that avoids a regular twill pattern.

It is an object of the invention to provide a paperforming fabric that results in minimal diagonal marking of paper being produced thereon, such as occurs in the use of regular twill weave patterns.

It is another object of the invention to provide a dimensionally stable paperforming fabric in which a substantial number of interlacings of both thread systems bind the threads to retain them in their positions relative to one another without shifting during use.

Another object of the invention is to provide a paperforming fabric that has predominant cross machine thread knuckles on the wear side to withstand the abrasion to which the fabric is subjected. These threads may have relatively long knuckles to present a substantial surface area, and thereby relieve the machine direction threads of wear.

Another object of the invention is to produce a paperforming fabric that can have different knuckle heights for the two thread systems to meet the particular requirements of a specific installation on a papermaking machine.

A further object of the invention is to produce a paperforming fabric that has low elongation in the machine direction.

A still further object is to provide a knuckle configuration on the paper side that produces good fiber orientation in the paper sheet.

And, another object is to produce a paperforming fabric that enhances water drainage. Due to the large number of interlacings in the weave pattern, the caliper or thickness, of the fabric is increased, and this results in a greater amount of void volume within the fabric which can enhance water drainage. Increased caliper also enhances a fabric's ability to maintain the same drainage characteristics for a longer period of time.

The foregoing and other objects and advantages of the invention will appear from the following description. In the description, reference is made to the accompanying drawings which form a part hereof, and in which there is shown by way of illustration and not of limitation several embodiments of the invention. Such embodiments do not represent the full scope of the invention, and reference is made to the claims herein for interpreting the breadth of the invention.

BRIEF DESCRIPTION OF THE DRAWINGS

FIG. 1 is a perspective view of a flat woven paperforming fabric illustrating an embodiment of the present invention woven in a five harness weave;

FIG. 8 is a schematic plan view of one repeat of a paperforming fabric illustrating a third embodiment of the invention woven in a six harness weave;

FIG. 9 is a schematic plan view of one repeat of a paperforming fabric illustrating a fourth embodiment of the invention woven in a seven harness weave; and FIG. 10 is a schematic plan view of one repeat of a paperforming fabric illustrating a fifth embodiment of the invention woven in an eight harness weave.

DESCRIPTION OF PREFERRED EMBODIMENT

Figure 2:
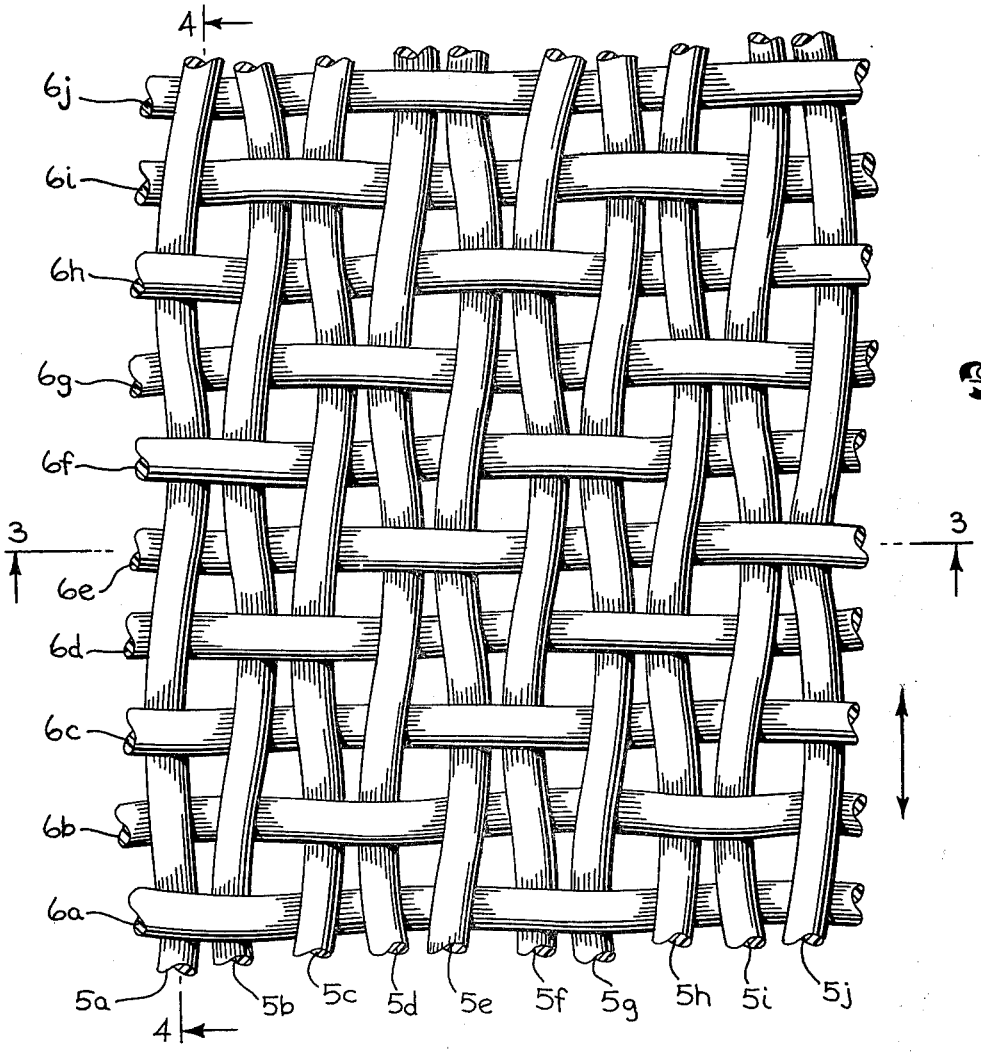
FIG. 2 is a plan view of a portion of the paper supporting side of the fabric of FIG. 1 shown on an enlarged scale and prepared from a photograph.

Referring to FIG. 1, there is shown a paperforming fabric 1 of the present invention suitable for use in a Fourdrinier machine or some other type of equipment constituting the wet end of a papermaking machine. The fabric 1 is woven flat on a conventional loom, and is then fashioned into an endless belt by forming a seam 2 joining its two ends. The fabric 1 has a paper supporting surface 3, and a wear surface 4 that travels over and around the rolls, dewatering elements, and suction boxes of a paperforming machine. Since the fabric 1 is flat woven, warp threads 5 run in the direction of travel when on the paper machine, which is termed the machine direction herein. The weft threads 6 then extend in the cross machine direction of the belt. Although the fabric 1 is described as being flat woven, endless weaving is not excluded. If woven endless, the warp threads will extend in the cross machine direction, and the weft threads will extend in the machine direction of the belt.

The machine direction and cross machine direction thread systems are both comprised of synthetic, monofilament threads. Polyester is the preferred material, but other materials and multifilaments may be used so long as they exhibit requisite physical characteristics for producing the fabric and for use as a paperforming medium. Furthermore, although the drawings illustrate threads as being substantially circular in cross section, fabrics of the invention may also be woven from noncircular threads. It should also be noted that the fabrics may be multilayered, in which event the invention is applicable to each layer.

Figure 3:
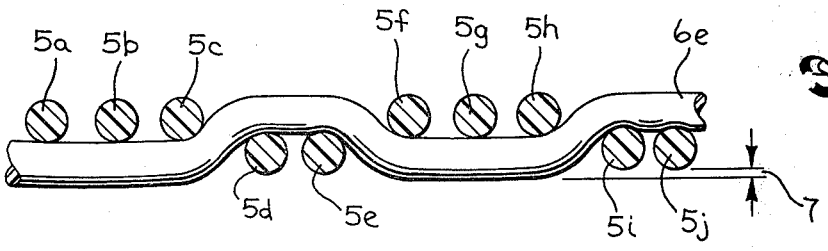
FIG. 3 is a schematic view in section of the fabric shown in FIG. 2 taken through the plane 3—3 extending along a cross machine direction thread, but which does not purport to show true thread profiles.

Referring now to FIG. 2, the fabric 1 is woven in a five-harness weave, and the portion of the paper supporting side 3 that is illustrated constitutes a two by two repeat, i.e. two thread repeats in each direction. The machine direction is indicated by the double headed arrow at the right hand side. FIG. 3 illustrates the two weave repeats for the cross machine direction, or weft, threads 6*e*, which is typical of all weft threads 6. Thread 6*e* passes under a set of three warp threads 5*a*, 5*b*, and 5*c*, and then interlaces upwardly through the warp thread system to pass over a set of two warp threads 5*d* and 5*e*. This repeat of under three-over two is repeated along the full length of the thread 6*e*, and also along the lengths of all the other weft, or cross machine threads 6.

Figure 4:
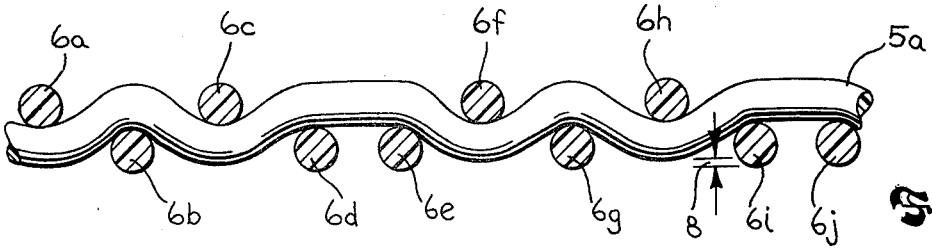
FIG. 4 is another schematic view in section of the fabric shown in FIG. 2 taken through the plane 4—4 extending along a machine direction thread.

FIG. 4 shows the two weave repeats of the machine direction, or warp, thread 5*a*. Commencing at the left, it passes beneath a single weft thread 6*a*, then interlaces upwardly through the weft thread system to pass over and around a single weft thread 6*b*, then interlaces downwardly through the weft thread system to pass beneath another single weft thread 6*c*, then interlaces upwardly through the weft thread system to pass over a set of two weft threads 6*d* and 6*e*, and finally interlaces back down through the weft system to complete a single weave repeat. This repeat is continued along the full length of the thread 5*a*, and also along the lengths of the other machine direction, or warp threads 5. It can be called a one under-one over-one under-two over repeat.

The described pattern of FIGS. 2–4 has the long weft, or cross machine knuckles on the wear side 4, and by controlling manufacturing techniques of weaving and heat treating these long weft knuckles can be exposed on the wear side beneath the warp, or machine direction, knuckles, as illustrated by the small arrows 7 and 8 in FIGS. 3 and 4. The long crosswise knuckles then become the predominant bearing, or wear surface 4 of the fabric 1. The machine direction, or warp, threads 5 which only have their short knuckles, comprising single crossovers, on the wear side are largely relieved of abrasive wear, and as the tension members in the fabric can better sustain the imposed tension loads, because they will not wear away as quickly as if their wear side knuckles were exposed. This technique of receding the machine direction knuckles is not new, but is attainable in the present invention along with other advantages that are specific and unique to the invention.

As seen in FIG. 4, the faric 1 has the long machine direction, or warp, knuckles on the paper supporting surface 3. These knuckles are illustrated as being at the same level, or in the same plane as the cross machine knuckles of the paper supporting surface 3. This common plane relationship results in a uniform support surface for paper formation that usually minimizes paper marking. This is not a new knuckle relationship, but again it is an achievement of the invention to combine desirable known characteristics with new features of the invention. In referring to a common plane for the knuckle heights of the two thread systems, it is meant that the knuckle levels are within about 0.0005 inch of one another. Other plane differences can also be achieved in manufacture of the fabric if desired. Thus, the machine direction thread knuckles on the paper side may be receded into the fabric, below the cross machine knuckles for installations where this is desirable.

Referring back to FIG. 2, other characteristics of the fabric are observable. First, there is an elimination of a regular twill pattern. Shading has been applied to indicate the extent of the exposed knuckles of both the machine direction and cross machine direction threads on the paperforming side. The cross machine thread knuckles all comprise two crossovers, i.e. each thread 6 crosses over two threads 5 in forming its knuckles, and none of these knuckles overlap the knuckles of adjacent threads. Hence, they are not in regular twill. The knuckles of the machine direction, or warp, threads 5 vary in length, some having a single crossover and the others two crossovers. Each double crossover overlaps single crossovers of the adjacent threads, but the difference in knuckle lengths distinguishes from a regular twill. For paperforming, the elimination of a regular twill reduces sheet marking to achieve a better paper product. On the wear side of the fabric, the machine direction threads 5 only have single crossover knuckles, which cannot be in twill pattern. The cross machine thread knuckles are of three crossovers in length. These knuckles advance from one thread to the successive thread by two warps, and therefore are not in regular twill.

A second apparent characteristic of the fabric 1 is a marked lateral crimp in the warp, or machine direction, threads 5. Where the cross direction threads 6 cross over two adjacent machine direction threads 5 they appear in FIG. 2 to squeeze these machine direction threads toward one another. This lateral crimping, whether it be formed in weaving or in subsequent heat treating of the fabric, has manifested itself to a relatively high degree in weaves of the invention, and it is believed to bind the threads in place to resist individual thread displacement and fabric elongation. Lateral crimp angles as high as seven degrees have been obtained in fabric specimen of 78 machine direction threads per inch of 0.17 mm diameter and sixty to sixty-two cross machine direction threads of 0.20 mm diameter. A crimp of about seven degrees is believed to be greater than in other fabrics. The crimp angle may vary, however, with mesh count, thread diameter, and techniques of manufacture.

There may be more vertical crimp in the machine direction threads 5 than in prior five harness fabrics, due to the increased number of interlacings within each weave repeat. It has been a prior practice in manufacturing synthetic papermaking fabrics to minimize crimping in the machine direction threads by use of Atlas weaves. These are weaves of five harness or more with each thread having only two knuckles in a weave repeat, one knuckle being on each fabric face, and one of the two knuckles having only a single crossover. The present invention departs from this practice by increasing the number of interlacings, but resistance to fabric elongation has been maintained. This may be due to increased lateral crimp, which does not pull out under tension loading, as does vertical crimp with a resulting crimp interchange, and also to judicious heat treatment after weaving.

The orientation of the two thread systems may be altered from that shown in FIGS. 2–4. One alteration is to turn the fabric 1 inside out, i.e. top to bottom, if desired, to present the long cross machine knuckles on the paperforming surface 3. This is believed advantageous in some paperforming operations for improving fiber orientation or better sheet release from the fabric.

Figure 5:
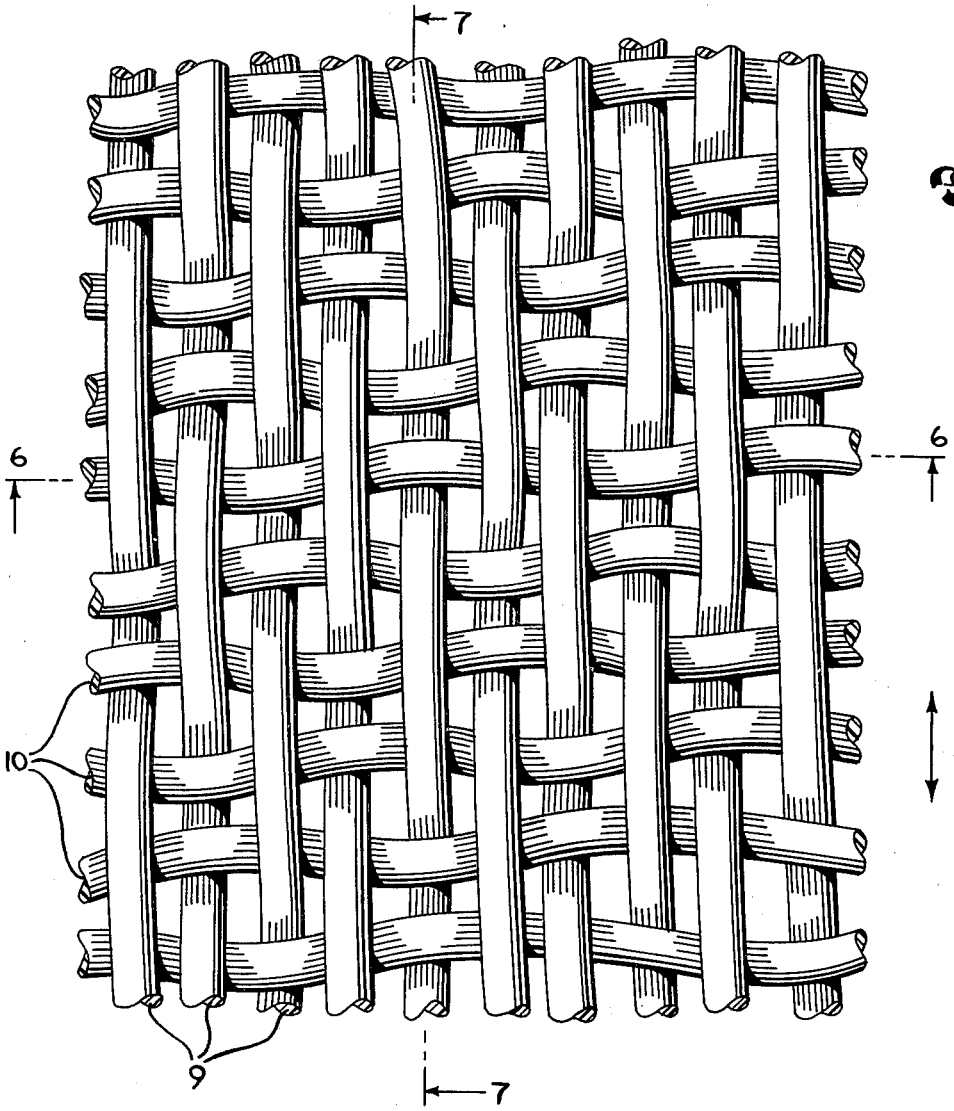
FIG. 5 is a plan view of a portion of the paper supporting side of a second embodiment shown on an enlarged scale and prepared from a photograph.
Figure 6:
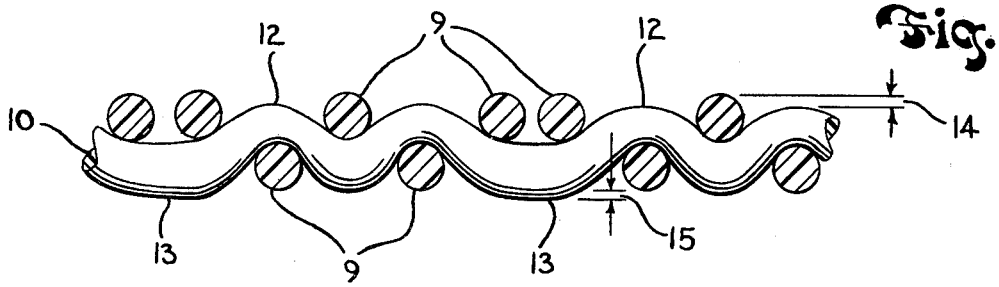
FIG. 6 is a schematic view in section of the fabric shown in FIG. 5 taken through the plane 6—6 extending along a cross machine direction thread, but which does not purport to show true thread profiles.
Figure 7:
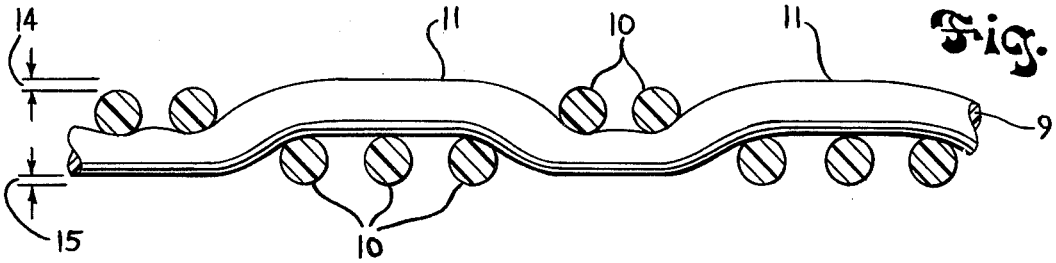
FIG. 7 is another schematic view in section of the fabric shown in FIG. 5 taken through the plane 7—7 extending along a machine direction thread.

A further alternative arrangement for the fabric is to rotate the pattern ninety degrees, as has been done for the five-harness weave shown in FIGS. 5, 6 and 7. In FIG. 5, the machine direction is shown by the double headed arrow at the right hand side. The machine direction threads 9 which are warp threads if the fabric is flat woven and seamed, have a three over-two under weave repeat, and two repeats are shown in FIG. 5, as well as in FIG. 7 which schematically shows a lengthwise section of a machine direction thread 9.

The cross machine threads 10 have a one over-one under-one over-two under weave repeat, and a lengthwise portion consisting of two weave repeats is shown in FIG. 6. The threads 10 now have four interlacings through the fabric in each weave repeat, and may have substantial vertical crimp, but this should not pose a problem since these threads are not subject to tension loading like machine direction threads. They also now incorporate the lateral crimp characteristic of the five-harness weave of the invention. The machine direction threads 9, on the other hand, have only two interlacings through the fabric in each weave repeat, and after heat setting under tension may exhibit minimal stretch under load.

In the arrangement of FIGS. 5–7, it has been found possible to raise the machine direction thread knuckles 11 on the paper side of the fabric above the cross machine thread knuckles 12, while at the same time retaining the cross machine knuckles 13 on the wear side beneath the machine direction threads. This is beneficial for making certain paper grades, for which raised machine direction knuckles improve formation, while simultaneously retaining most of the wear on the cross machine threads. It is believed this knuckle height relationship is unique for synthetic fabrics exhibiting minimal stretch under load. The differences in knuckle heights are illustrated in FIGS. 6 and 7 by the arrows 14 and 15. The arrows 14 depict the raised machine direction knuckles on the paper side, and the arrows 15 depict the exposed cross machine knuckles on the wear side. The showings are, however, illustrative only, for FIGS. 6 and 7 are not intended to accurately portray knuckle and crimp formation.

The knuckle height relationship of the fabric of FIGS. 5–7 is not solely the result of the weave pattern. The conditions in weaving and heat setting also play a function in obtaining the final knuckle heights. In general, fabrics with high machine direction knuckles on the paper side and exposed cross machine knuckles on the wear side have been obtained by reducing loom tensions during weaving. Loom tensions may be reduced by 20 to 25 percent. For heat setting, tension has been increased slowly in the machine direction to about a 10 to 11 percent stretch, while allowing for a sidewise shrinkage of about 6.5 to 7.7 percent. These figures are only illustrative, for they cannot be quantified for all fabrics and manufacturing equipment. Each loom and heat setting apparatus has its own operating characteristics, and mesh count and thread diameters also influence the end result, so that skill of the art must determine particular manufacturing parameters.

FURTHER EMBODIMENTS OF THE INVENTION

FIGS. 8, 9 and 10 illustrate the invention in six, seven and eight harness fabrics. A one by one weave repeat is shown for each fabric in a block type diagram, as is commonly employed for representing fabric weaves. Vertical rows represent successive machine direction threads, and the squares filled in either a black mottling or an "X" denote crossovers of the machine direction threads on the paper side of the fabrics.

The seven harness weave of FIG. 9 will be described to show how a weave pattern of the invention is developed. The black mottled squares are in a satin pattern, and this particular satin of FIG. 9 is based on what is referred to in the textile art as a counter of two. This means that each black square is two squares to the right and one square up from a preceding black square. To this array of black mottled squares in a satin pattern additional crossovers are added to the pattern, as shown by the squares having an "X." A like cluster of "X" squares are associated with each black mottled square, and all squares in a cluster are adajcent their host black mottled square. The squares in a cluster are selected so as to avoid a regular twill pattern. In FIG. 6, each cluster comprises an adjacent square to the upper left, an adjacent square directly above, and an adjacent square to the right of the host, black mottled square. The resulting pattern is a granite weave, as herein defined, and it is apparent that more than one cluster pattern could be adopted to achieve the desired result.

In the eight harness weave illustrated in FIG. 10, the black mottled squares represent a satin pattern developed from a counter of three, i.e. a black mottled square is three to the right and one up from the preceding black mottled square. The cluster of additional raisers, or crossovers on the paper side, are represented by squares with an "X," and are above, to the upper right, and at the right of the host, black mottled square. The base satin pattern and the clusters can also be arranged in other patterns, so long as the basic premise of obtaining a granite pattern, as herein described, is adhered to.

In FIG. 8 there is illustrated a one by one repeat of a six harness weave. As is known, a true satin cannot be developed in a six harness pattern, but a broken satin pattern can be employed in which the crossovers of the pattern are not adjacent one another. This is illustrated by the black mottled squares in FIG. 8. The additional crossovers are clustered to each black mottled square in positions above and to the right thereof. This forms a granite pattern, so that in each embodiment the granite type pattern is a feature of the construction.

Other granite patterns can be employed by arranging the clusters of crossovers in different squares. Also, the patterns can be turned ninety degrees, or inverted from one face of the fabric to the other, as previously described in connection with the fabric of FIGS. 2–4. There are several characteristics of a granite pattern, as that term is used herein. First, there must be at least five harnesses to develop a weave repeat of five or more for both thread systems. Second, there is a base satin pattern, or in the case of the six-harness weave a broken satin pattern. The term "satin" as used in defining the invention thus includes a broken-satin for harness counts that cannot be woven in a true satin, as well as a true satin. A third characteristic is that there should not be any regular twill pattern, as hereinbefore defined.

Some characteristics in addition to the granite pattern have been incorporated into the fabrics being described. First, the fabric of the invention is preferably even sided. For purposes herein, a fabric is said to be even sided when the number of crossovers in the weave repeat of each thread on one side of the fabric is the same as, or as close as possible to, the number of crossovers on the other side of the fabric. When a weave repeat extends over an odd number of threads, as in the five and seven harness weaves of FIGS. 2–4, 5–7 and 9, the difference in crossovers for each thread between the two fabric sides should be a factor of only one. For even numbered harnesses, as in FIGS. 8 and 10, the number of crossovers for each thread is the same for each fabric face.

A further characteristic of the fabrics described is that the warp and weft threads have relatively short knuckles. For this purpose, neither a machine direction, or cross machine direction knuckle should exceed three crossovers in length, and in five harness weaves this maximum knuckle length can only occur in one thread system. By examining the drawings, it is readily seen that there are no long knuckles in any thread system that exceeds three crossovers in length.

The embodiments described relate to paperforming fabrics intended for use in the wet end of papermaking machines. However, the fabrics may also have utility in other applications, such as in the press or dryer sections of a paper machine, and hence may relate to papermaking generally. The fabric has as a principal objective the reduction in diagonal marking of paper. To this end, the fabric departs from usual fabrics characterized by a minimal number of interlacings of the threads through the fabric in each weave repeat. Instead, it introduces substantial numbers of interlacings for both thread systems, yet it is believed the fabric has good dimensional stability. The increased interlacings produce greater body for the fabric, so that it should lay flat in firm contact with the paper machine elements. It also should exhibit desirable drainage because of a relatively high void volume due to increased caliper, or thickness of the fabric. Knuckle heights on both sides of the fabric can be controlled, to place greater wear on cross machine threads, and to develop a desirable paper formation surface on the outer face of the fabric. The forming side can have either the cross machine or machine direction threads predominate, or the thread knuckles can lie in a common plane. Good life characteristics also can be imparted to the fabric by protruding cross machine knuckles on the wear side, and the invention, therefore, provides an improved fabric for papermaking.

I claim:

1. In a papermaking fabric having machine direction and cross machine direction thread systems that interlace with one another, the combination of:

a weave repeat pattern of at least five crossovers for each thread system to form thread knuckles in each thread system on opposite sides of the fabric;

threads in both the machine direction and cross machine direction having interlacings in each weave repeat to be even sided;

thread knuckles of the machine and cross machine directions not exceeding more than three crossovers in length; and the thread knuckles of both the machine and cross machine direction thread systems having a non-regular twill pattern.

2. A papermaking fabric as in claim 1, wherein said fabric is woven in a six-harness weave, with at least some of the threads in each thread system having at least four interlacings through the fabric in a weave repeat, and each thread having the same number of crossovers on each fabric side.

3. A papermaking fabric as in claim 1, wherein said fabric is woven in a seven-harness weave, with each thread having at least four interlacings through the fabric in a weave repeat.

4. A papermaking fabric as in claim 1, wherein said fabric is woven in an eight-harness weave, with each thread interlacing through the fabric at least four times in a weave repeat, and each thread also having the same number of crossovers on each fabric side.

5. A papermaking fabric as in claim 1, wherein the thread knuckles of the machine and cross machine direction thread systems on the paper supporting side of the fabric are in a common plane relationship with one another.

6. A papermaking fabric as in claim 1, wherein the thread knuckles of the cross machine direction threads on the wear side of the fabric extend beyond the plane of the machine direction thread knuckles on the wear side of the fabric to take the predominant wear of the fabric.

7. A papermaking fabric as in claim 1, wherein the thread knuckles of the machine direction threads on the paperforming side rise above the cross machine thread knuckles.

8. In a papermaking fabric having machine direction and cross machine direction thread systems that interlace with one another, the combination of:

a weave repeat pattern of at least five crossovers for each thread system to form thread knuckles in each thread system on opposite sides of the fabric;

threads in both the machine direction and cross machine direction having interlacings in each weave repeat to be even sided;

thread knuckles of the machine and cross machine directions not exceeding more than three crossovers in length;

thread knuckles of both the machine and cross machine direction thread systems having a non-regular twill pattern;

said fabric is woven in a five-harness weave, threads of one thread system having four interlacings through the fabric in each weave repeat to have three knuckles each comprising a single crossover and one knuckle comprising a double crossover, and the threads of the other thread system having two interlacings through the fabric in each weave repeat to have one knuckle comprising a double crossover and a second knuckle comprising a triple crossover.

9. In a papermaking fabric of interwoven first and second thread systems extending crosswise to one another and with the threads of the two systems interlaced to form opposite fabric faces with knuckles of both thread systems dispersed across each face, the combination of:

threads in the first system having a weave repeat of five crossovers in which a thread:

(a) passes across a single thread of the second thread system on a first fabric face, (b) laces through the fabric and passes across a single thread of the second thread system on the opposite fabric face, (c) laces through the fabric and passes across a single thread of the second thread system on the first fabric face, (d) laces through the fabric and passes across a pair of threads of the second thread system on the opposite fabric face, and (e) laces through the fabric to the first fabric face;

threads of the second system having a weave repeat of five crossovers in which a thread:

(f) passes across a set of three of the threads of the first thread system on the first fabric face, (g) laces through the fabric and passes across a pair of threads of the first thread system on the opposite fabric face, and (h) laces through the fabric to the first fabric face.

10. A fabric as in claim 9, wherein said threads of the first thread system are machine direction threads, and said threads of the second thread system are cross machine direction threads.

11. A fabric as in claim 9, wherein said first fabric face is a wear surface of the fabric, and said opposite fabric face is a paper forming surface of the fabric.

12. A papermaking fabric made of interwoven machine direction and cross machine direction threads, comprising:

machine and cross machine direction threads with a weave repeat pattern of at least five, each thread interlacing through the fabric to be even sided;

threads of both the machine direction and cross machine direction having long knuckles that pass across not more than three threads in length; and threads of the machine direction and cross machine direction having clusters of thread interlacings distributed on the fabric around a base satin weave arrangement to present a nonregular twill pattern.

13. In a papermaking fabric of interwoven synthetic machine direction and cross machine direction threads, a weave of at least five harnesses having:

a base configuration of crossovers in a satin pattern on one fabric side, with additional crossovers clustered around each crossover of the satin pattern to present:

(a) an even sided fabric, in which the number of crossovers on the opposite fabric faces in each weave repeat of a thread are within a count of one, and (b) a non-regular twill pattern.

14. A fabric as in claim 13 wherein the longest knuckles of each thread do not exceed three crossovers.

15. In a papermaking fabric of interwoven synthetic machine direction and cross machine direction threads, a five harnesses weave having:

a base configuration of crossovers in a satin pattern on one fabric side, with additional crossovers clustered around each crossover of the satin pattern to present:

(a) an even sided fabric, in which the number of crossovers on the opposite fabric faces in each weave repeat of a thread are within a count of one, and (b) a non-regular twill pattern; and threads of one thread system having four interlacings through the fabric in each weave repeat, and threads of the other thread system having at least two interlacings through the fabric in each weave repeat.

16. In a papermaking fabric of two interwoven thread systems, the interweaving of the threads having:

(a) a weave of at least five crossovers in a weave repeat for each thread system, (b) a base satin pattern on one fabric side with like additional crossovers clustered around each crossover of the satin pattern, and (c) a non-regular twill configuration.

* * * * *